US010673146B1

(12) United States Patent
Wroblewski

(10) Patent No.: US 10,673,146 B1
(45) Date of Patent: Jun. 2, 2020

(54) HYBRID COMMUNICATION SYSTEM INCLUDING A MOUNTING STRUCTURE FOR AN OPTICAL ELEMENT

(71) Applicant: United States of Americas as represented by the Administrator of NASA, Washington, DC (US)

(72) Inventor: Adam Wroblewski, North Olmsted, OH (US)

(73) Assignee: United States of America as Represented by the Administrator of National Aeronautics and Space Administration, Washington, DC (US)

( * ) Notice: Subject to any disclaimer, the term of this patent is extended or adjusted under 35 U.S.C. 154(b) by 49 days.

(21) Appl. No.: 16/049,165

(22) Filed: Jul. 30, 2018

Related U.S. Application Data

(60) Provisional application No. 62/539,218, filed on Jul. 31, 2017.

(51) Int. Cl.
*H01Q 19/19* (2006.01)
*H01Q 5/22* (2015.01)
*H01Q 25/00* (2006.01)

(52) U.S. Cl.
CPC ..... *H01Q 19/19* (2013.01); *H01Q 5/22* (2015.01); *H01Q 25/007* (2013.01)

(58) Field of Classification Search
CPC ..... H01Q 25/00; H01Q 3/26; H01Q 1/007; H01Q 1/246; H01Q 3/08; H01Q 3/18;
(Continued)

(56) References Cited

U.S. PATENT DOCUMENTS 3,407,404 A * 10/1968 Cook ..... H01Q 19/19 343/765
3,680,144 A * 7/1972 Low ..... H01Q 1/288 343/781 R (Continued)

OTHER PUBLICATIONS

Daniel E. Raible et al., "On the Physical Realizability of Hybrid RF and Optical Communications Platforms for Deep Space Applications", Aug. 4, 2014, 32nd AIAA International Communications Satellite Systems Conference, AIAA Space Forum, (AIAA 2014-4482).

*Primary Examiner* — Tho G Phan
(74) *Attorney, Agent, or Firm* — Robert H. Earp, III

(57) ABSTRACT

A communications system includes a radio frequency ("RF") antenna. The RF antenna includes a RF reflector and a RF feed axially spaced from the RF reflector. The communications system also includes an optical telescope sharing an axis with the RF antenna. The optical telescope includes primary and secondary reflectors centered at the axis. A mounting structure mechanically couples a housing of the primary reflector to the secondary optical reflector. The mounting structure includes a plurality of truss struts extending the entirety of an axial distance between the primary and secondary optical reflectors and a plurality of support rings interconnecting the plurality of truss struts at various locations on the central axis at or between the primary and secondary optical reflectors. Each of the plurality of support rings and truss struts is structured to minimize the cross section of the support rings along radials originating at the RF feed.

20 Claims, 6 Drawing Sheets

(58) Field of Classification Search
CPC ..... H01Q 3/20; H01Q 3/2605; H01Q 19/13; H01Q 1/288; H01Q 21/28; H01Q 3/16; H01Q 19/062; H01Q 19/132; H01Q 1/02; H01Q 1/42; H01Q 21/20; H01Q 25/007; H01Q 3/14; H01Q 5/22; H01Q 5/55; H01Q 13/22; H01Q 15/08; H01Q 15/14; H01Q 19/12; H01Q 19/134; H01Q 19/19; H01Q 19/192; H01Q 19/193; H01Q 1/088; H01Q 1/125; H01Q 1/3257; H01Q 21/0025; H01Q 21/0087; H01Q 21/08; H01Q 3/04; H01Q 3/06; H01Q 3/36
See application file for complete search history.

(56) References Cited

U.S. PATENT DOCUMENTS 5,182,569 A * 1/1993 Bui-Hai ..... H01Q 15/141 343/781 CA
5,214,438 A * 5/1993 Brusgard ..... F41G 7/008 343/725
5,557,292 A * 9/1996 Nygren ..... H01Q 1/288 343/753
5,680,145 A * 10/1997 Thomson ..... H01Q 1/288 343/915
6,204,822 B1 * 3/2001 Cardiasmenos ..... H01Q 3/18 343/757
6,268,835 B1 * 7/2001 Toland ..... H01Q 1/08 343/781 P
8,094,081 B1 1/2012 Bruzzi et al.

* cited by examiner

HYBRID COMMUNICATION SYSTEM INCLUDING A MOUNTING STRUCTURE FOR AN OPTICAL ELEMENT

CROSS REFERENCE TO RELATED APPLICATION

This application claims benefit of U.S. Provisional Patent Application Ser. No. 62/539,218 filed on Jul. 31, 2017. The subject matter of this earlier-filed application is hereby incorporated by reference in its entirety.

ORIGIN OF DISCLOSURE

The present disclosure is based on work performed by employees of the United States Government and may be manufactured and used by or for the Government for Government purposes without the payment of any royalties thereon or therefore.

TECHNICAL FIELD

The present disclosure relates to hybrid optical and radio frequency communication systems. More particularly, the present disclosure relates to a mounting structure for a secondary optical mirror in a hybrid communication system that minimizes disturbance of a radio frequency signal.

BACKGROUND

Various bottlenecks exist in existing deep space communication systems that limit the ability to aggregate large volumes of data in exploration missions. For example, radio frequency ("RF") communication systems have relatively slow data rates and spectrum limitations. In view of these limitations of RF, there are various proposals to use laser-based communication systems for deep space missions. In fact, the Lunar Laser Communication Demonstration recently demonstrated the potential of such systems, returning data from the moon at a rate of 622 MBPS.

However, RF-based systems still have certain advantages over purely optical systems. The robust RF communications network already in existence on Earth facilitates the utilization of such systems, for example. Additionally, an optical system may be ineffective during periods of solar obscuration or poor atmospheric conditions in space-to-ground configurations.

Given the advantages of each of these frequency bands, a hybrid system utilizing both RF and optical frequencies may be beneficial. Several difficulties exist in implementing such a system. To minimize the footprint of such a system, a shared-aperture construction may be used where optical and RF elements (e.g., primary and secondary optical reflectors, an RF feed, etc.) are coaxially disposed with respect to one another. Such a construction creates a tradeoff between stability of optical elements and blockage to the RF feed. A structure that maximizes the stability of a secondary optical reflector, for example, may degrade performance in RF communications by blocking a portion of the RF signal. Therefore, a mounting structure for an optical element of a shared-aperture hybrid communication system that enhances the stability of the optical element while minimizing RF blockage may be beneficial.

SUMMARY

One embodiment is directed to a communications system. The communications system includes a radio frequency ("RF") reflector having an opening disposed at a central axis of the communications system and a RF feed attached to the RF reflector via a support structure. The RF feed is disposed at a first location on the central axis. The communications system also includes a primary optical reflector disposed in alignment with the opening and also centered about the central axis. The communications system also includes a secondary optical reflector attached to the primary optical reflector via a mounting structure disposed proximate to the opening. The secondary optical reflector is disposed at a second location on the central axis between the first location and the primary optical reflector. The mounting structure includes a plurality of axial components extending the entirety of an axial distance between the primary and secondary optical reflectors. The mounting structure also includes a plurality of circumferential components interconnecting the plurality of axial components at various axial positions. Cross-sectional areas of the axial and circumferential components are minimized along direct propagation paths between the RF reflector and the RF feed.

Another embodiment relates to a communications system. The communications system includes a radio frequency ("RF") antenna including a RF reflector and a RF feed axially spaced from the RF reflector. The communications system also includes an optical telescope sharing an axis with the RF antenna. The optical telescope includes a primary optical reflector centered at the axis and is mechanically isolated from the RF reflector. The primary optical reflector is disposed within a housing. The optical telescope also includes a secondary optical reflector disposed on the axis between the primary optical reflector and the RF feed. The optical telescope also includes a mounting structure mechanically coupling the housing to the secondary optical reflector. The mounting structure includes a plurality of truss struts extending the entirety of an axial distance between the primary and secondary optical reflectors and a plurality of support rings interconnecting the plurality of truss struts at various locations on the central axis at or between the primary and secondary optical reflectors. Each of the plurality of support rings is inclined at a different angle along radials originating at the RF feed.

Another embodiment relates to an optical telescope for a hybrid communications system. The optical telescope includes a primary optical reflector having a central axis and disposed within a housing. The optical telescope also includes a mounting structure attached to the housing and extending parallel to the central axis and circumferentially surrounding the central axis. The optical telescope also includes a secondary optical reflector attached to the mounting structure at an end of the mounting structure. The optical reflector is centered at the central axis. The mounting structure includes a plurality of axial components extending the entirety of an axial distance between the primary and secondary optical reflectors and a plurality of circumferential components interconnecting the plurality of axial components at a plurality of axial locations. Cross-sectional areas of the axial and circumferential components are minimized along radials of a sphere having a center a predetermined axial distance from the secondary optical reflector.

In various embodiments described herein, the cross-sectional areas of both the circumferential and axial components are minimized relative to a hemispherical propagation of rays originating from an RF feed of an incorporating hybrid communications system.

BRIEF DESCRIPTION OF THE DRAWINGS

In order that the advantages of certain embodiments will be readily understood, a more particular description of the invention briefly described above will be rendered by reference to example embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
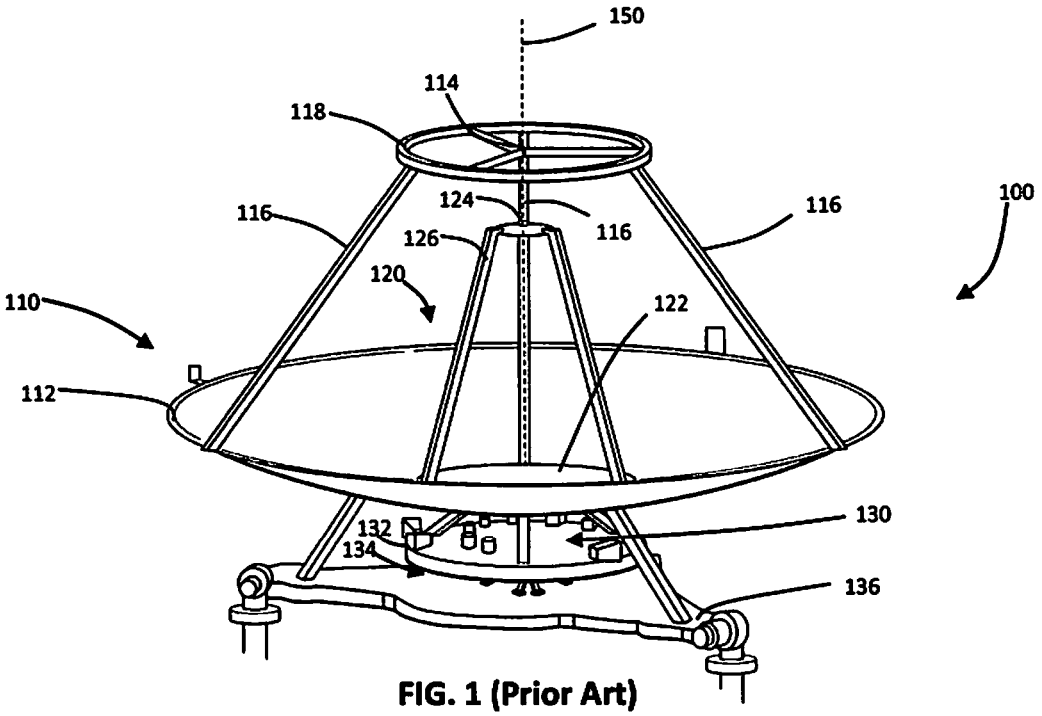
FIG. 1 (Prior Art)
FIG. 1 is a perspective view of a prior art hybrid communications system attached to a communications deck, according to an example embodiment.

Referring generally to the Figures, described herein is a hybrid communication system including a radio frequency ("RF") antenna and an optical telescope. In various embodiments, the RF antenna includes a RF feed and a RF reflector (e.g., a Cassegrain reflector) having a central axis. The optical telescope includes a primary reflector disposed proximate to a surface of the RF reflector. The primary reflector is centered about the central axis. In some embodiments, the optical telescope includes a secondary reflector disposed along the central axis and a mounting structure coupling the primary reflector to the secondary reflector.

In various embodiments described herein, the mounting structure is designed to minimize blockage of radiation propagating from the RF feed towards the RF reflector. For example, in certain embodiments, the mounting structure includes a plurality of axial components extending primarily in the direction of the central axis. The axial components may extend the entirety of the axial distance between the primary and secondary reflectors. Various ones of the axial components may include a minimal cross-sectional areas in directions perpendicular to propagation paths between the RF feed and the RF reflector so as to minimize blockage of an RF signal. Various forms for the axial components are envisioned. For example, in certain embodiments, the axial components may include beams extending parallel or substantially parallel to the central axis. Each of the beams may have a trapezoidal or rectangular cross section, and a longer side of the cross section may extend radially inward towards the central axis to minimize blockage of the RF feed. In another embodiment, the axial components may extend at angles with respect to the central axis and form geometries (e.g., triangles) with other ones of the axial components to provide enhanced structural support to the secondary optical reflector.

In various embodiments, the mounting structure also includes a plurality of circumferential components disposed at various axial locations of the mounting structure. The circumferential components surround or substantially surround the central axis and may interconnect the axial components of the mounting structure to maximize the structural support provided thereby. In some embodiments, each circumferential component has a trapezoidal cross-section, and includes an inclined section centered about the central axis. Each inclined section may extend at a different angle with respect to the central axis. The angles may be chosen to minimize blockage of the RF feed.

The angle at which the inclined section of each circumferential component extends may depend the axial position of the circumferential component. For example, in one embodiment, the mounting structure includes at least two circumferential components: a first axially disposed proximate to the primary reflector and a second disposed between the primary and secondary optical reflectors. The incline angle of the first circumferential component may be less than the incline angle of the second circumferential component. In some embodiments, the circumferential components are inclined to extend along radials of an imaginary sphere centered about the RF feed. This way, the cross-section of each circumferential component lying in direct propagation paths between the RF feed and the RF reflector is minimized. Thus, the mounting structures described herein provide robust support to the secondary optical reflector while minimizing disturbance to the RF signal, thereby improving performance of existing hybrid communication systems.

Referring now to FIG. 1, a prior art hybrid communication system 100 is shown, according to an example embodiment. As shown, the hybrid communications system 100 includes a RF subsystem 110 and an optical subsystem 120 that are co-bore sighted and share the same aperture. As shown, the hybrid communications system 100 is disposed on a communications deck 136. In various embodiments, the communications deck 136 is securely attached to an outer space vehicle (e.g., a satellite, an exploration vehicle, etc.).

As shown, the RF subsystem 110 includes a RF reflector 112 and a RF feed 114 having a central axis 150. RF feed 114 is configured to transmit radio waves radially outward therefrom such that at least a portion of the radio waves are reflected by the RF reflector 112 in a desired direction (e.g., towards a communication recipient on Earth). The RF feed 114 is suspended via struts 116 and a supporting ring 118 at a first location on the central axis 150. In certain embodiments, a phase center of the RF feed 114 is placed at a virtual focus of the RF reflector 112. One of the struts 116 may also serve as a waveguide to couple an amplifier to the RF feed 114 to generate the radio waves.

The optical subsystem 120 includes a primary optical reflector 122 and a secondary optical reflector 124. In various embodiments, the RF reflector 112 includes an opening that is centered about the central axis 150. The primary optical reflector 122 may be disposed in a location such that the primary optical reflector 122 is aligned with the opening. In some embodiments, the primary optical reflector 122 is disposed in a housing that includes a steering optical system 130 disposed on an optical deck 132. The steering optical system 130 may include an optical source and additional optical components configured to direct an optical signal through an opening in the primary optical reflector 122. The optical signal reflects off the secondary optical reflector 124, and then off the primary optical reflector 122 towards a communications recipient. The housing including the optical deck 132 and primary optical reflector 122 may be suspended on a vibration isolation device 134 disposed on the communications deck 136 such that the optical subsystem 120 is vibrationally isolated from the RF subsystem 110.

As shown, the secondary optical reflector 124 is disposed at a second location on the central axis 150 between the primary optical reflector 122 and the RF feed 114. The secondary optical reflector 124 may be transparent to RF radiation to minimize interference with RF signals transmitted by the RF feed 114. In various embodiments, the secondary optical reflector is placed at a focal point of the primary optical reflector 122. Precise placement of the secondary optical reflector 124 ensures proper redirection of an optical beam (e.g., from the steering optical system 130) to a communications target. Accordingly, a set of struts 126 support the secondary optical reflector 124. The struts 126 are constructed of a material that is not transparent to RF radiation to facilitate the precise alignment of the secondary optical reflector 124.

As shown, hybrid communications system 100 includes three struts 126 that are equally distributed about the circumference of the primary optical reflector 122. Struts 126 have a rectangular cross section that is substantially uniform. There are several limitations with such a design. Since the struts 126 are constructed of a material that is not transparent to RF frequency, the struts 126 block RF signals emanating from the RF feed 114 and therefore diminish radio signals that are delivered to a communications target. Moreover, the struts 126 are not interconnected with one another. Such a design requires the struts 126 to individually possess a certain stiffness to provide the necessary stability to the secondary optical reflector 124. In order to provide this requisite stiffness, relatively large struts (e.g., having a large cross-sectional area) are required, which will inevitably block a significant portion of the RF signal.

Figure 2A:
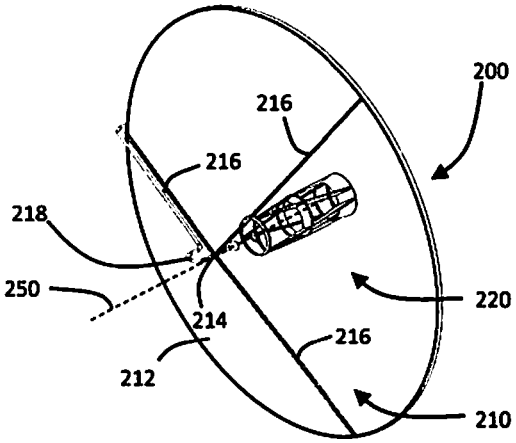
FIGS. 2A-2C are perspective views of a hybrid communications system, according to an example embodiment.
Figure 2B:
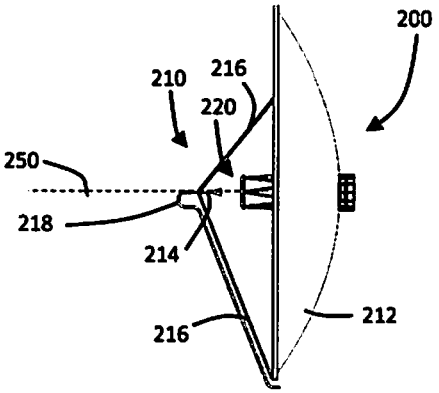
Figure 2C:
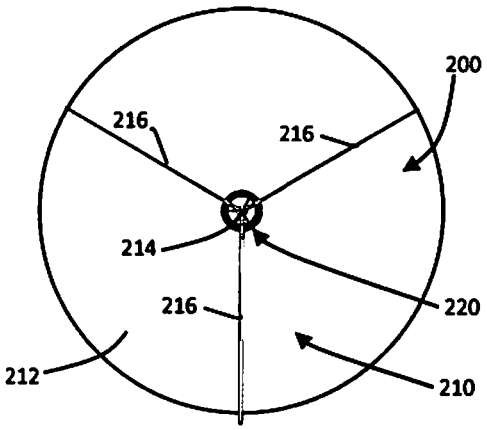

Referring now to FIGS. 2A-2C, perspective views of a hybrid communication system 200 are shown, according to an example embodiment. Unless otherwise noted, the hybrid communications system 200 may include several components that are similar to those discussed above with respect to the hybrid communications system 100 described with respect to FIG. 1. As shown, the hybrid communications system 200 includes an RF subsystem 210 and an optical subsystem 220 that share the same aperture.

As shown, the RF subsystem 210 includes a RF reflector 212 and an RF feed 214. The RF feed 214 is attached to the RF reflector 212 via a plurality of struts 216 extending from a periphery of the RF reflector 212. One of the struts 216 has a hook 218 extending from an end thereof and the RF feed 214 extends from the hook 218 towards a central axis 250 of the hybrid communications system 200. The strut 216 including the hook 218 may also serve as a waveguide/transmission line for an alternating current signal originating from an amplifier disposed on an underside of the RF reflector 212. Radio waves are emitted from the RF feed 214, radiate spherically outward therefrom, and are redirected/focused via the RF reflector 212 towards a communications target. In various embodiments, a phase center of the RF feed 214 is placed at a virtual focus of the RF reflector 212. It should be appreciated that the present disclosure is compatible with numerable alternative attachment structures for the RF feed 214. The RF reflector 212 may be mechanically fastened to a spacecraft or other vehicle.

As shown, the optical system 220 includes an optical telescope 222. The optical telescope 222 may be secured to the spacecraft or other vehicle via a mechanical isolation device such that the optical telescope 222 is vibrationally isolated from the RF reflector 212. The optical telescope 222 is designed to improve performance over the optical subsystem 120 described with respect to FIG. 1. In short, the optical telescope 222 is designed to provide robust support to a secondary optical reflector contained therein while minimizing blockage of the RF signal emanating from the RF feed 214 towards the RF reflector 212. Such improvements are achieved through a mounting structure that attaches a secondary optical reflector to the remainder of the hybrid communications system 200. The structure of the optical telescope 222 is described in greater detail with respect to FIGS. 3A-3C.

Figure 3A:
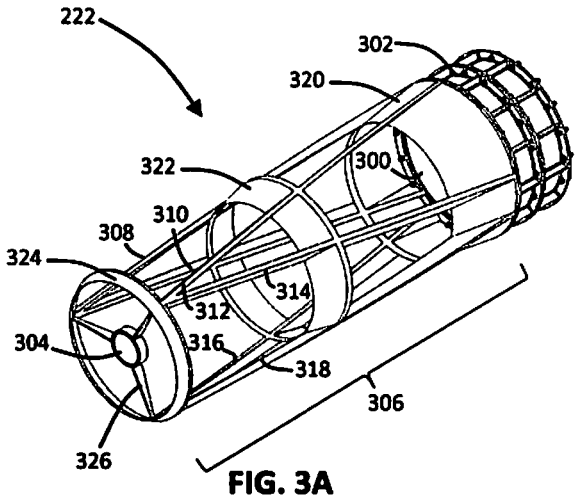
FIGS. 3A-3F are various views of an optical telescope of a hybrid communications system, according to an example embodiment.
Figure 3B:
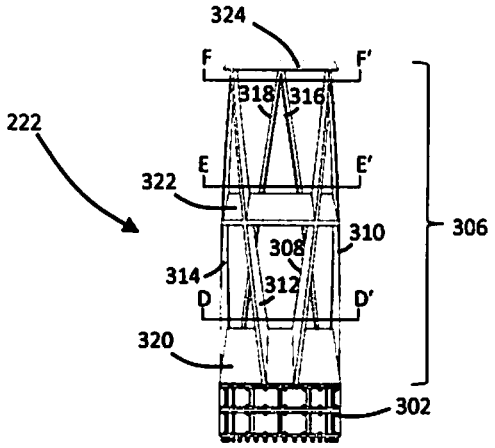
Figure 3C:
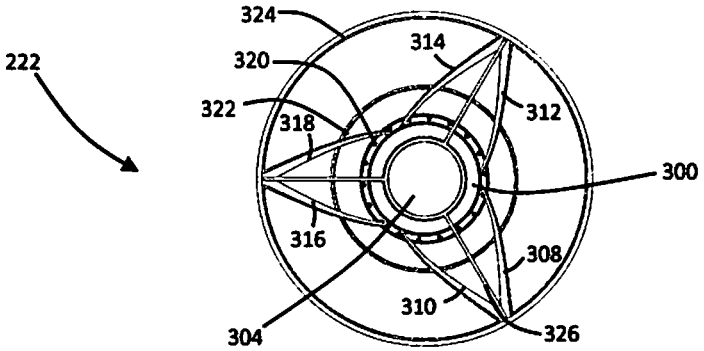

Referring now to FIGS. 3A-3C, perspective views of the optical telescope 222 are shown, according to an example embodiment. As shown, the optical telescope 222 includes a primary optical reflector 300 disposed within a housing 302. In one embodiment, the primary optical reflector is mounted upon three flexure mounts attached to an internal platform disposed at a central plane of the housing 302. Housing 302 may also contain various elements (e.g., the steering optical system 130 and optical deck 132) described with respect to FIG. 1. The housing 302 may be affixed to a vibration isolation platform to mechanically isolate the optical telescope structure 222 from the RF reflector 212.

Optical telescope 222 also includes a secondary optical reflector 304 axially displaced from the primary optical reflector 300. The secondary optical reflector 304 is suspended a fixed axial distance from the primary optical reflector 300 via a mounting structure 306. In the example shown, the mounting structure 306 includes a plurality of axial components 308, 310, 312, 314, 316, and 318 as well as a plurality of circumferential components 320, 322, and 324. As shown, the plurality of axial components 308, 310, 312, 314, 316, and 318 each extend the entirety of the axial distance between the primary and secondary optical reflectors 300 and 304. Each of the circumferential components 320, 322, and 324 interconnects each of the plurality of axial components 308, 310, 312, 314, 316, and 318 at various axial locations along the axial distance to enhance the stability of the secondary optical reflector 304.

In the example shown, each of the axial components 308, 310, 312, 314, 316, and 318 are twisted struts that extend at an angle to the central axis 250. The axial components 308 and 310 are azimuthally spaced apart from one another at a first end of the mounting structure 306 proximate to the housing 302. The axial components 308 and 310 converge with one another and meet at a second end of the mounting structure 306 that is substantially co-planar with the secondary optical reflector 304. In other words, the axial components 308 and 310 form a circumferential triangle having an apex approximately in the plane of the secondary optical reflector 304. Additional circumferential triangles are formed via axial components 312, 314, 316, and 318, respectively. The triangular structures formed by various sets of the axial components is beneficial because it provides robust structural support to the secondary optical reflector 304 while limiting the amount of structural material closest to the RF feed 214. It should be appreciated that the optical telescope 222 may include any number of axial components that form any number of geometries consistent with the present disclosure.

Each of the axial components have a cross-section that varies in orientation with distance from the primary optical reflector 300. In various embodiments, the orientations of the cross-sectional areas are governed by radials originating at the exit aperture of the RF feed 214. The cross-sectional areas are oriented so as to be minimized in planes perpendicular to the radials marking direct propagation paths between the RF feed 214 and the RF reflector 212. Since the axial components extend at angles to the central axis, the axial components are twisted about a long axis thereof to minimize RF blockage. In various embodiments, the axial components continuously vary in width throughout the axial distance between the primary and secondary optical reflectors 300 and 304. In other words, the cross-sectional areas of the axial components are maximal at the first end of the mounting structure 306 and minimal at the second end of the mounting structure 306 in order to minimize RF blockage and maximize support. The structure of the axial components are described in creater detail with respect to FIGS. 3D-3F.

In the example shown, the mounting structure 306 includes a first circumferential component 320, a second circumferential component 322, and a third circumferential component 324. The first circumferential component 320 extends from the first end of the mounting structure 306 and is most proximate to the primary optical reflector 300. The third circumferential component 324 is disposed at the second end of the mounting structure 306 and is substantially co-planar to the secondary optical reflector 304. A support structure 326 (e.g., three radial struts) extends radially inward from the third circumferential component 324 to provide a connection point for the secondary optical reflector 304. The second circumferential component 322 is disposed approximately halfway between the primary and secondary optical reflectors 300 and 304. It should be appreciated that any number of circumferential components may be included in the mounting structure 306.

In various embodiments, each of the circumferential components 320, 322, and 324 is a support ring that includes an inclined section (and/or possesses a trapezoidal cross section). Each inclined section may extend toward the central axis at an angle that is dependent on its axial position. In the example shown, the inclined section of the first circumferential component 320 extends at less of an angle with respect to the central axis than does the second circumferential component 322. The third circumferential component 324 in turn is angled even more with respect to the central axis than the second circumferential component 322. The angles are selected so that each of the inclined sections extends along a radial originating at an exit aperture of the RF feed 214. Such radials represent direct propagation paths between the RF feed 214 and the RF reflector 212. By altering the inclination angles of the circumferential components 320, 322, and 324 in this way, the propagation time between the RF feed 214 and RF reflector 212 is minimized, and performance of the hybrid communications system 200 is maximized. Additionally, the length of the inclined sections decreases with distance from the primary optical reflector 300 (i.e., the inclined section of the first circumferential component 320 is the greatest in length), which further minimizes RF blockage. The design principles behind the circumferential components is described in greater detail with respect to FIG. 5 herein.

Figure 3D:
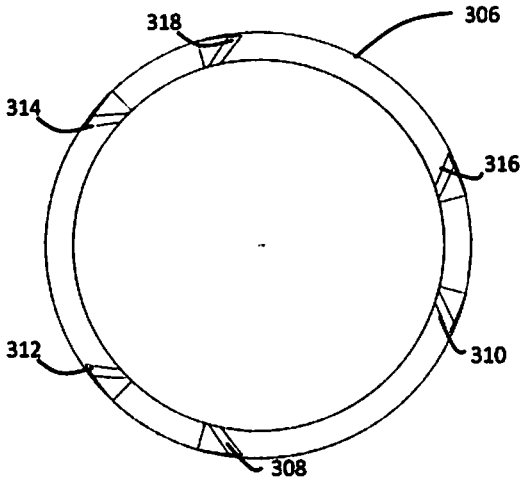
Figure 3E:
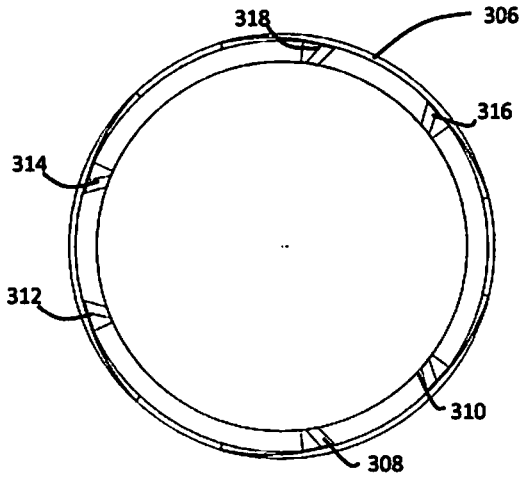
Figure 3F:
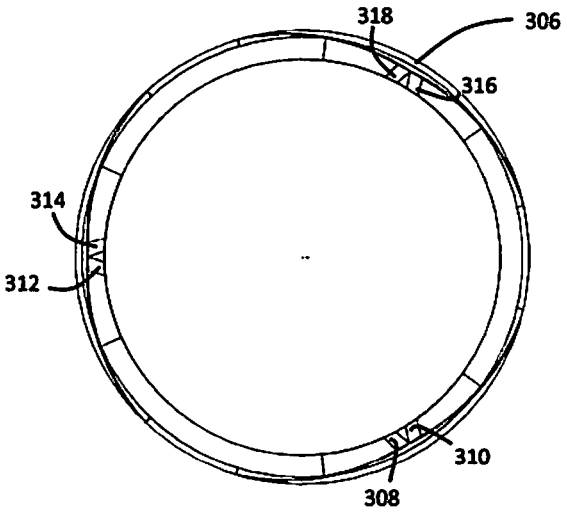

Referring now to FIGS. 3D-3F cross-sectional views of the mounting structure 306 at the lines D-D', E-E', and F-F' of FIG. 3B are shown, according to an example embodiment. As shown, the orientations of the axial components 308, 310, 312, 314, 316, and 318 changes with axial distance from the primary optical reflector 300. At the line D-D', for example, the axial components 308 and 310 are relatively fair apart azimuthally, their cross sections are close to parallel to one another, and they extend at substantial angles with respect to radials (i.e., imaginary lines connecting a circumference of the mounting structure 306 with its central axis) originating at inner ends thereof. At the line E-E', the axial components 308 and 310 are closer to one another due to their axial tilt, and their cross sections are converging with one another (i.e., their cross-sections are tilted towards one another). Thus, between the lines D-D' and E-E', the cross-sections of axial components 308 and 310 twist from extending almost parallel with respect to one another to converging towards one another by extending at lesser angles with respect to radials originating at inner ends thereof. At the line F-F', where the axial components 308 and 310 meet, the cross-sections of the axial components 308 and 310 extend at still lesser angles with respect to radials originating at inner ends thereof so as to form a v-shape at a second end of the mounting structure 306. Thus, in the shown embodiment, the angles at which cross-sections extend with respect to radials between the mounting structure 306 and the central axis 250 gets lesser with axial distance from the primary optical reflector 300. The other pairs of axial components 312-314 and 316-318 forming triangles follow a similar pattern.

As shown in FIGS. 3D-3F, each of the axial components 308, 310, 312, 314, 316, and 318 is disposed proximate to another one of the axial components 308, 310, 312, 314, 316, and 318 at a first end (e.g., proximate to the line D-D') of the mounting structure 306. For example, the axial component 310 is proximate to the axial component 316. These axial components that are proximate to one another at the first end of the mounting structure 306 diverge from one another with axial distance from the primary optical reflector 300 so as converge with other ones of the axial component 308, 310, 312, 314, 316, and 318 at a second end of the mounting structure 306. The axial components proximate to one another at the first end have tilted cross sections and extend at angles on opposing sides of radials originating at inner ends thereof. These initial angles of the cross-sections are selected and the axial components 308, 310, 312, 314, 316, and 318 are twisted so that projections of the cross-sectional areas of the axial components 308, 310, 312, 314, 316, and 318 to planes perpendicular to direct propagation paths between the RF feed 214 and the RF reflector 212 are minimized. Computational simulations have shown this design to improve RF blockage over existing support structures.

Figure 4:
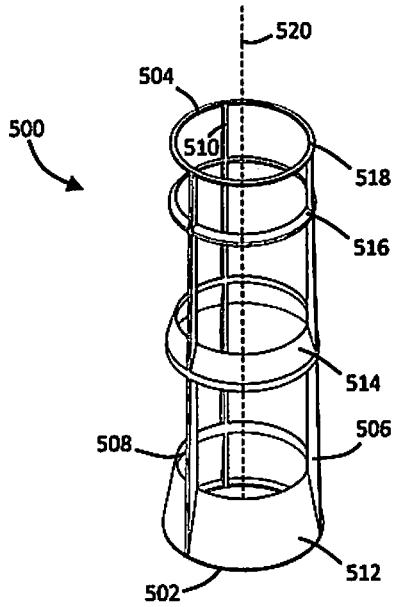
FIG. 4 is a perspective view of a mounting structure for an optical telescope, according to an example embodiment.

Referring now to FIG. 4, a perspective view of a mounting structure 500 is shown, according to an example embodiment. The mounting structure 500 may serve as an alternative to the mounting structure 306 described with respect to FIGS. 3A-3C. As shown, the mounting structure 500 includes a first end 502 and a second end 504. A primary optical reflector of a communications system incorporating the mounting structure 500 may be disposed proximate to the first end 502. A secondary optical reflector may be disposed proximate to the second end 504. As shown, for example, a support ring 518 is disposed at the second end 504. A support structure (e.g., a plurality of radial struts) may extend inward from the support ring 518 and suspend the secondary optical reflector at the second end 504 such that the secondary optical reflector is centered about a central axis 520 of the mounting structure 520.

The mounting structure 500 includes a plurality of axial components 506, 508, and 510.

Unlike the mounting structure 306, in the mounting structure 500, the axial components 506, 508, and 510 extend parallel (or substantially parallel) to the central axis 520. The axial components 506, 508, and 510 are uniformly dispersed throughout an outer circumference of the mounting structure 500. In various embodiments, cross-sections of the axial components 506, 508, and 510 are oriented such that smallest portions thereof extend towards the central axis 520 to minimize blockage of an RF feed. Widths of the axial components 506, 508, and 510 may continuously diminish with distance from the first end 502 to minimize an amount of support material near the second end 504.

The mounting structure 500 also includes a plurality of circumferential components 512, 514, and 516 disposed between the first and second ends 502 and 504. Like in the mounting structure 306, the circumferential components 512, 514, and 516 extend around the entirety of the outer circumference of the mounting structure 500. The circumferential components possess a trapezoidal cross-section and include inclined sections that are inclined with respect to the central axis 520 in manners dependent on the axial positions of the circumferential components. The circumferential components 512, 514, and 516 interconnect the plurality of axial components 506, 508, and 510 to maximize the structural support provided thereby. In various embodiment, the circumferential components 512, 514, and 516 are designed in accordance with the framework described with respect to FIG. 5 to minimize blockage of an RF signal.

Figure 5:
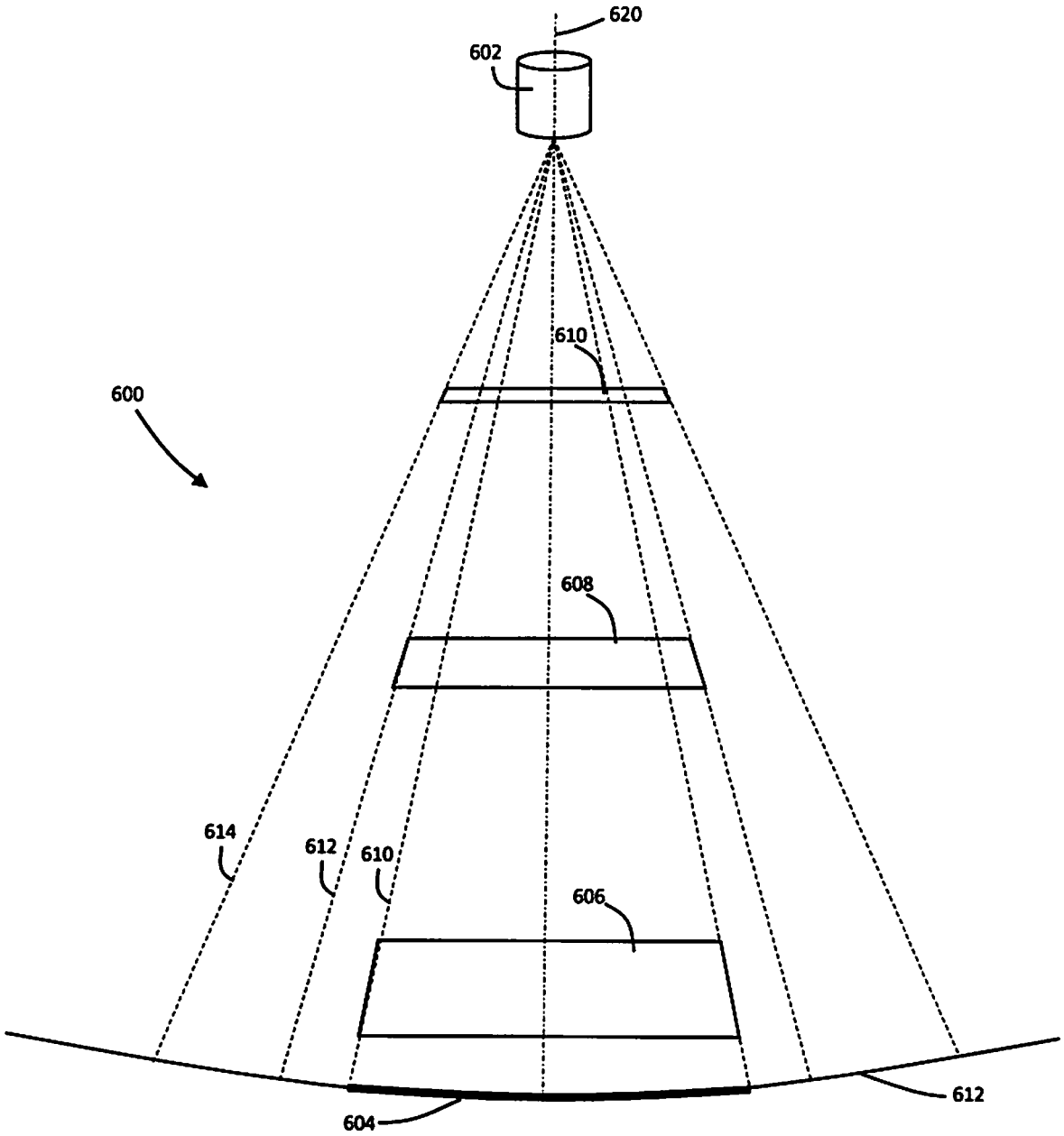
FIG. 5 is a diagram conceptualizing a design for a mounting structure for an optical telescope, according to an example embodiment.

Referring now to FIG. 5, a conceptual diagram of a mounting structure 600 for an optical telescope of a hybrid communications system is shown, according to an example embodiment. Various components are left out of FIG. 5 for purposes of clarity. As shown, the mounting structure 600 is disposed between a primary optical reflector 604 and an RF feed 602 of the hybrid communications system. The mounting structure 600 is shown to include a plurality of circumferential components 606, 608, and 610, through it should be appreciated that the mounting structure 600 also includes a plurality axial components consistent with other aspects of the present disclosure.

As shown, the primary optical reflector 604 is disposed proximate to a surface of a sphere 612 centered at an exit aperture of the RF feed 602. It should be appreciated that the primary optical reflector 604 may be displaced from the sphere 612 in various alternative embodiments. Moreover, although not depicted in FIG. 5, the hybrid communications system also includes an RF reflector that may be disposed proximate or displaced to the sphere 612 in various embodiments.

A plurality of sets of radials 610, 612, and 614 are shown to extend from the exit aperture of the RF feed 602 to the sphere 612. Each radial in each of the sets of radials 610, 612, and 614 extends at a common angle with respect to a central axis 620 of the mounting structure 600. In other words, the first set of radials 610 forms a first cone having a first apex angle. The other sets of radials 612 and 614 form additional cones having greater apex angles. Each radials in the sets of radials 610, 612 and 614 represents a direct propagation path between the RF feed 602 and the RF reflector. As shown, a first one of the circumferential components 606 includes an inclined section that extends at an angle such that it extends along the radials of the first set of radials 610. As a result, the first circumferential component 606 blocks a minimum amount of radio waves propagating along a direct propagation path between the RF feed 602 and the RF reflector. By increasing the structural rigidity of the mounting structure 600 (by interconnecting the axial components extending the axial distance between the primary and secondary optical reflectors) while minimizing RF blockage, this construction of the circumferential components enhances performance of optical telescopes for hybrid communications systems.

It will be readily understood that the components of various embodiments, as generally described and illustrated in the figures herein, may be arranged and designed in a wide variety of different configurations. Thus, the detailed description of the embodiments of the present invention, as represented in the attached figures, is not intended to limit the scope of the invention as claimed but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that embodiments of the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A communications system comprising:

a radio frequency ("RF") reflector, the RF reflector including an opening disposed at a central axis of the communications system;

a RF feed attached to the RF reflector via a support structure, the RF feed disposed at a first location on the central axis;

a primary optical reflector disposed in alignment with the opening and also centered about the central axis; and a secondary optical reflector attached to the primary optical reflector via a mounting structure disposed proximate to the opening and radially inward of the support structure, the secondary optical reflector disposed at a second location on the central axis between the first location and the primary optical reflector, wherein the mounting structure comprises:

a plurality of axial components extending the entirety of an axial distance between reflective surfaces of the primary and secondary optical reflectors; and a plurality of circumferential components interconnecting the plurality of axial components, wherein each of the plurality of circumferential components is disposed at one of a plurality of axial positions, wherein one of the axial positions is between the reflective surfaces, wherein cross-sectional areas of the axial and circumferential components are minimized along direct propagation paths between the RF reflector and the RF feed.

2. The communications system of claim 1, wherein cross-sectional areas of the axial components diminish with axial distance from the primary optical reflector.

3. The communications system of claim 1, wherein the plurality of axial components is dispersed at equal azimuthal intervals about the central axis.

4. The communications system of claim 3, wherein each of the axial components comprises a beam having a rectangular or trapezoidal cross section, the beam extending parallel to the central axis.

5. The communications system of claim 3, wherein each of the axial components comprises a pair of support members extending the entirety of the axial distance, wherein each of the support members includes a first end disposed proximate to the primary optical reflector and a second end disposed proximate to the secondary optical reflector, wherein, in each pair of support members, the first ends are disposed proximate to different points along a circumference of the primary optical reflector, wherein the second ends of each of the support members in a pair meet such that each pair of support members forms a circumferential triangle.

6. The communications system of claim 5, wherein an apex of each circumferential triangle formed by the plurality of axial components is coplanar with the secondary optical reflector.

7. The communications system of claim 1, wherein the mounting structure includes a first end a second end disposed approximately at the second location, wherein the first end is attached to a back-end optics housing containing the primary optical reflector.

8. The communications system of claim 7, wherein the plurality of circumferential components includes a first circumferential component extending from the first end and a second circumferential component disposed between the primary and secondary optical reflectors.

9. The communications system of claim 8, wherein the first circumferential component includes a first inclined section extending at a first angle towards the central axis and the second circumferential component includes a second inclined section extending at a second angle towards the central axis, wherein the first angle is less than the second angle.

10. The communications system of claim 9, wherein the first and second angles are chosen such that the first and second inclined sections extend along radials originating from a point on the RF feed.

11. The communications system of claim 9, wherein a surface area of the first inclined section is at least double a surface area of the second inclined section.

12. The communications system of claim 9, further comprising an additional circumferential component disposed between the second circumferential component and the secondary optical reflector, the additional circumferential component comprising an additional inclined section extending at a third angle greater than the second angle.

13. The communications system of claim 12, wherein the mounting structure further comprises a mounting ring for the secondary optical reflector, the mounting ring disposed substantially coplanar to the secondary optical reflector, wherein the mounting structure further comprises a plurality of support arms extending from the mounting ring to the secondary optical reflector.

14. A communications system comprising:

a radio frequency ("RF") antenna comprising a RF reflector and a RF feed axially spaced from the RF reflector via a support structure; and an optical telescope sharing an axis with the RF antenna, the optical telescope comprising:

a primary optical reflector centered at the axis, wherein the primary optical reflector is mechanically isolated from the RF reflector and disposed within a housing attached to a rear surface of the RF reflector;

a secondary optical reflector disposed on the axis between the primary optical reflector and the RF feed; and a mounting structure mechanically coupling the housing to the secondary optical reflector, wherein the mounting structure is disposed radially inward of the support structure and comprises:

a plurality of truss struts extending the entirety of an axial distance between reflective surfaces of the primary and secondary optical reflectors; and a plurality of support rings interconnecting the plurality of truss struts, wherein each of the plurality of support rings is disposed at an axial location, wherein one of the axial locations is between the reflective surfaces, wherein each of the plurality of support rings is inclined at a different angle to align the support rings along radials originating at the RF feed.

15. The communications system of claim 14, wherein the support rings have decreasing cross-sectional areas with axial distance from the primary optical reflector.

16. The communications system of claim 15, wherein the plurality of truss struts are dispersed at equal azimuthal intervals about the axis.

17. The communications system of claim 16, wherein the truss struts form a plurality of triangles having apexes that are substantially coplanar to the secondary optical reflector.

18. An optical telescope for a hybrid communications system comprising:

a primary optical reflector having a central axis and disposed within a housing;

a mounting structure attached to the housing and extending parallel to the central axis and circumferentially surrounding the central axis; and a secondary optical reflector attached to the mounting structure at an end of the mounting structure, wherein the secondary optical reflector is centered at the central axis, wherein the mounting structure comprises:

a plurality of axial components extending the entirety of an axial distance between the primary and secondary optical reflectors, wherein the mounting structure extends between reflective surfaces of the primary and secondary optical reflectors; and a plurality of circumferential components interconnecting the plurality of axial components at a plurality of axial locations, wherein one of the axial locations is between the reflective surfaces, wherein cross-sectional areas of the circumferential and axial components are minimized along radials of a sphere having a center a predetermined axial distance from the secondary optical reflector.

19. The optical telescope of claim 18, wherein the circumferential components have decreasing cross-sectional areas with axial distance from the primary optical reflector.

20. The telescope of claim 19, wherein the axial components form a plurality of triangles having apexes that are substantially coplanar to the secondary optical reflector.

* * * * *